United States Patent [19]

Surkamp

[11] Patent Number: 4,699,181

[45] Date of Patent: Oct. 13, 1987

[54] ROTARY DOBBY

[75] Inventor: Paul Surkamp, Kempen, Fed. Rep. of Germany

[73] Assignee: Johann Kaiser GmbH & Co. KG, Bayreuth, Fed. Rep. of Germany

[21] Appl. No.: 876,380

[22] Filed: Jun. 19, 1986

[30] Foreign Application Priority Data

Jun. 19, 1985 [DE] Fed. Rep. of Germany ..... 3521780

[51] Int. Cl.[4] ..... D03C 1/00; F16D 11/06

[52] U.S. Cl. ..... 139/76; 74/570

[58] Field of Search ..... 139/66 R, 76, 66 A; 192/28, 29, 33 R, 71; 74/84 R, 112, 116, 570, 526, 527

[56] References Cited

U.S. PATENT DOCUMENTS

| | | | |
|---|---|---|---|
| 3,804,128 | 4/1974 | Amigues | 139/66 R |
| 3,807,460 | 4/1974 | Alexandr et al. | 139/76 |
| 4,230,210 | 10/1980 | Hintsch | 139/66 R |
| 4,354,531 | 10/1982 | Surkamp et al. | 139/66 R |
| 4,367,770 | 1/1983 | Schwarz | 139/66 R |
| 4,643,231 | 2/1987 | Brock et al. | 139/76 |
| 4,646,788 | 3/1987 | Brock et al. | 139/66 R |

FOREIGN PATENT DOCUMENTS

| | | | |
|---|---|---|---|
| 3414640 | 10/1985 | Fed. Rep. of Germany | 139/76 |
| 1201358 | 12/1959 | France | 139/66 R |
| 1348879 | of 1964 | France | 139/66 R |

*Primary Examiner*—Harvey C. Hornsby
*Assistant Examiner*—Joseph S. Machoga
*Attorney, Agent, or Firm*—Herbert L. Lerner; Laurence A. Greenberg

[57] ABSTRACT

A rotary dobby includes a drive shaft assembly, an eccentric mechanism releasably coupled to the drive shaft assembly, the eccentric mechanism including a connecting rod having a coupling joint to be connected to a shaft linkage and the eccentric mechanism including an eccentric disc carried by the connecting rod, the eccentric disc having a radially directed wedge guide formed therein, the drive shaft assembly having two diametrically opposite detent grooves formed therein, a coupling wedge, a device for shifting the coupling wedge in the wedge guide and in the detent grooves according to a pattern during a rest position of the drive shaft assembly, the eccentric disc and the connecting road, and a device for arresting the connecting rod in two rest positions thereof.

10 Claims, 14 Drawing Figures

FIG. 1
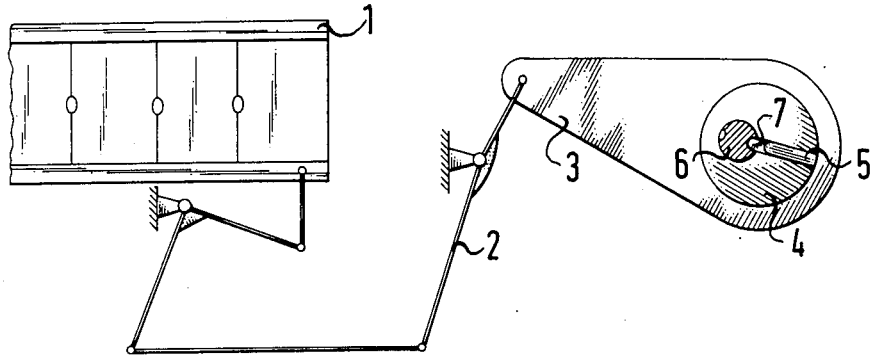
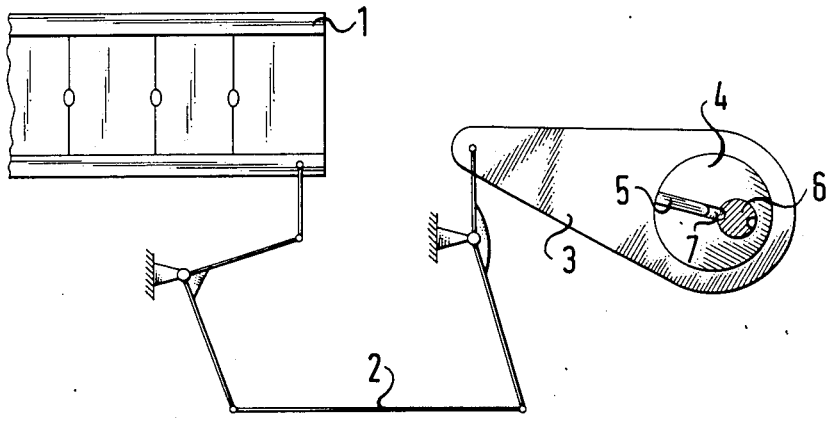
FIG. 2

ROTARY DOBBY

The invention relates to a rotary dobby including a drive shaft, an eccentric mechanism for moving the drive shaft, the eccentric mechanism including a connecting rod having a coupling joint to be connected to a shaft linkage and the eccentric mechanism including an eccentric disc carried by the connecting rod, the eccentric disc having a radially directed wedge guide formed therein, the drive shaft or a disc connected to the drive shaft having two diametrically opposite detent grooves formed therein, a coupling wedge, and a mechanism for shifting the coupling wedge in the wedge guide and in the detent grooves according to a pattern during a rest position of the drive shaft, the eccentric disc and the connecting rod.

In dobbies or heald machines of this type, shifting creates difficulties, making it impossible to increase production speed.

It is conventional to arrest the eccentric disc relative to the connecting rod with the aid of a disengagable coupling wedge, in order to prevent any motion of the parts with respect to each other in their rest positions.

However, the shifting of the coupling wedge produces increased friction causing considerable wear. The shifting must be performed rapidly and if the coupling wedge is not properly engaged in the arresting position, the machine can be damaged or break, or faulty shifting might also occur if the connecting rod moves in an impermissible manner. In order to prevent this, resiliently shiftable detent means are provided, in which the wedge should be engaged. However, such means cannot prevent malfunctions of the wedge.

It is accordingly an object of the invention to provide a rotary dobby, which overcomes the hereinafore-mentioned disadvantages of the heretofore-known devices of this general type, which permits an increase in productivity and working speed and which ensures that the shifting of the coupling wedge is effected without wear and without any reduction in operational reliability, while the connecting rod simultaneously remains fixed in its rest position.

With the foregoing and other objects in view there is provided, in accordance with the invention, a rotary dobby, comprising a drive shaft assembly, an eccentric mechanism for moving the drive shaft assembly, the eccentric mechanism including a connecting rod having a coupling joint to be connected to a shaft linkage and the eccentric mechanism including an eccentric disc carried by the connecting rod, the eccentric disc having a radially directed wedge guide formed therein, the drive shaft assembly having two diametrically opposite detent grooves formed therein, a coupling wedge, means for shifting the coupling wedge in the wedge guide and in the detent grooves according to a pattern during the rest position of the drive shaft assembly, the eccentric disc and the connecting rod, and means for arresting the connecting rod in two rest positions thereof.

In accordance with another feature of the invention, the drive shaft assembly includes a drive shaft and a disc connected to the drive shaft having the detent grooves formed therein.

Preferably, the arresting means are provided in a plane which passes through the coupling joint, the axis of rotation of the drive shaft, the coupling wedge and its arresting grooves, in the rest position. Since the connecting rod is mainly loaded in this plane during operation, the eccentric disc and the connecting rod are at a dead position in the rest position, and only relatively small forces are required to fix the connecting rod and therefore also the eccentric disc in the rest positions.

In accordance with a further feature of the invention, the arresting means are formed of two mutually interlocking parts with teeth, one of the parts being disposed on the connecting rod and the other of the parts being disposed outside the connecting rod, and means for resiliently deflecting at least one of the parts into contact with the other.

Therefore, after the coupling wedge has been engaged, the resilient part of the arresting means can shift, so that it does not obstruct the motion of the connecting rod from one rest position to the other.

In accordance with an added feature of the invention, one of the parts is a roller and the other of the parts is a depression matching the roller in a member.

In accordance with an additional feature of the invention, the roller is disposed on the connecting rod, the member is a lever, and the resilient deflecting means includes a fixed axis about which the lever pivots.

In accordance with again another feature of the invention, one of the parts is a roller disposed on the connecting rod, the other of the parts is in the form of a lever with two arms extending at least partly around the roller, the arms having a respective depression or notch formed therein matching the roller, and the resilient deflecting means includes a fixed axis about which the lever pivots for engaging the roller in the depressions from respective opposite sides of the roller.

In accordance with again a further feature of the invention, one of the parts is a notch or depression formed in the connecting rod, the other of the parts includes a roller matching the depression, and the resilient deflecting means moves the roller into engagement with the depression.

In accordance with again an added feature of the invention, there is provided an arm connected to the connecting rod, one of the parts being in the form of a notch or depression formed in the arm and a notch or depression formed in the connecting rod and directed against the depression formed in the arm, the other of the parts including a roller matching the depressions, and the resilient deflecting means selectively moves the roller into engagement with the depression.

In accordance with again an additional feature of the invention, the other of the parts includes a lever carrying the roller and being pivotable about a fixed axis, and the resilient deflecting means includes a spring mechanism having at least one spring pivoting in accordance with the motion of the lever for changing the direction and strength of the force of the spring.

In accordance with yet another feature of the invention, there is provided an arm connected to the connecting rod, one of the parts being in the form of a first roller disposed on the arm and a second roller disposed on the connecting rod opposite the first roller, the other of the parts includes a lever having two sides with depressions or notches formed therein and being pivotable about a fixed axis, and the resilient deflecting means selectively moves one of the depressions into engagement with one of the rollers.

In accordance with a concomitant feature of the invention, the lever has a lower surface, and the resilient deflecting means includes a zero setting device having fixed stops, a rocker interlocking with the lever through teeth, and a spring biasing the rocker against the lower surface of the lever and against the fixed stops.

Faulty shifting and faulty arrests cannot occur during the disengagement of the coupling wedge. The coupling wedge is simply disengaged and in the disengaged state it causes no arresting operations. As in the known prior art, in the engaged state it can arrest itself in the coupled condition, until it is released from this condition by the shifting device, which is controlled according to a pattern.

Other features which are considered as characteristic for the invention are set forth in the appended claims.

Although the invention is illustrated and described herein as embodied in a rotary dobby, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic view of a model or pattern of a drive shaft in the lower shed position or setting;

FIG. 2 is a view similar to FIG. 1 of a model or pattern of a drive shaft in the higher shed position or setting;

Figure 5:
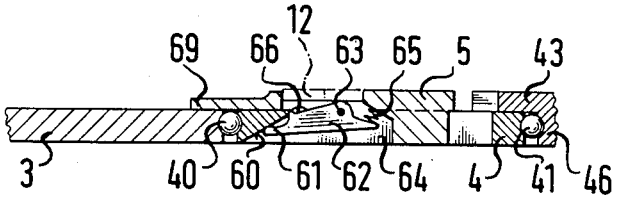
FIG. 5 is a fragmentary, central, longitudinal-sectional view of the coupling wedge.

Referring now to the figures of the drawings in detail and first, particularly, to FIG. 1 thereof, there is seen a shaft 1 which is brought into a lower shed position or setting by a connecting rod 3. The connecting rod 3 is supported on an eccentric disc 4. A coupling wedge 5 is disengaged at the moment illustrated in FIG. 1. A drive shaft 6 can freely rotate without taking the eccentric disc 4 along. After each half revolution, the drive shaft 6 stops moving for a short time, in order to permit shifting of the coupling wedge 5, if required.

The eccentric disc 4 together with the drive shaft 6 rotates 180 degrees, if the coupling wedge 5 is radially displaced so that it is engaged in a detent groove 7 in the drive shaft 6. The connecting rod 3 therefore moves from the rest position shown in FIG. 1 to the rest position shown in FIG. 2. The connecting rod 3 therefore moves the shaft 1 into the higher shed position or setting illustrated in FIG. 2. If the coupling wedge 5 is disengaged again, the drive shaft 6 can then freely rotate.

According to FIGS. 3 to 8, the coupling wedge 5 has an open shifting groove 10, in which one of two control or shifter pieces 11, 12 of control or shifting rods 13, 14, respectively, can engage. Details of the coupling wedge 5 will be described in greater detail below.

Figure 10:
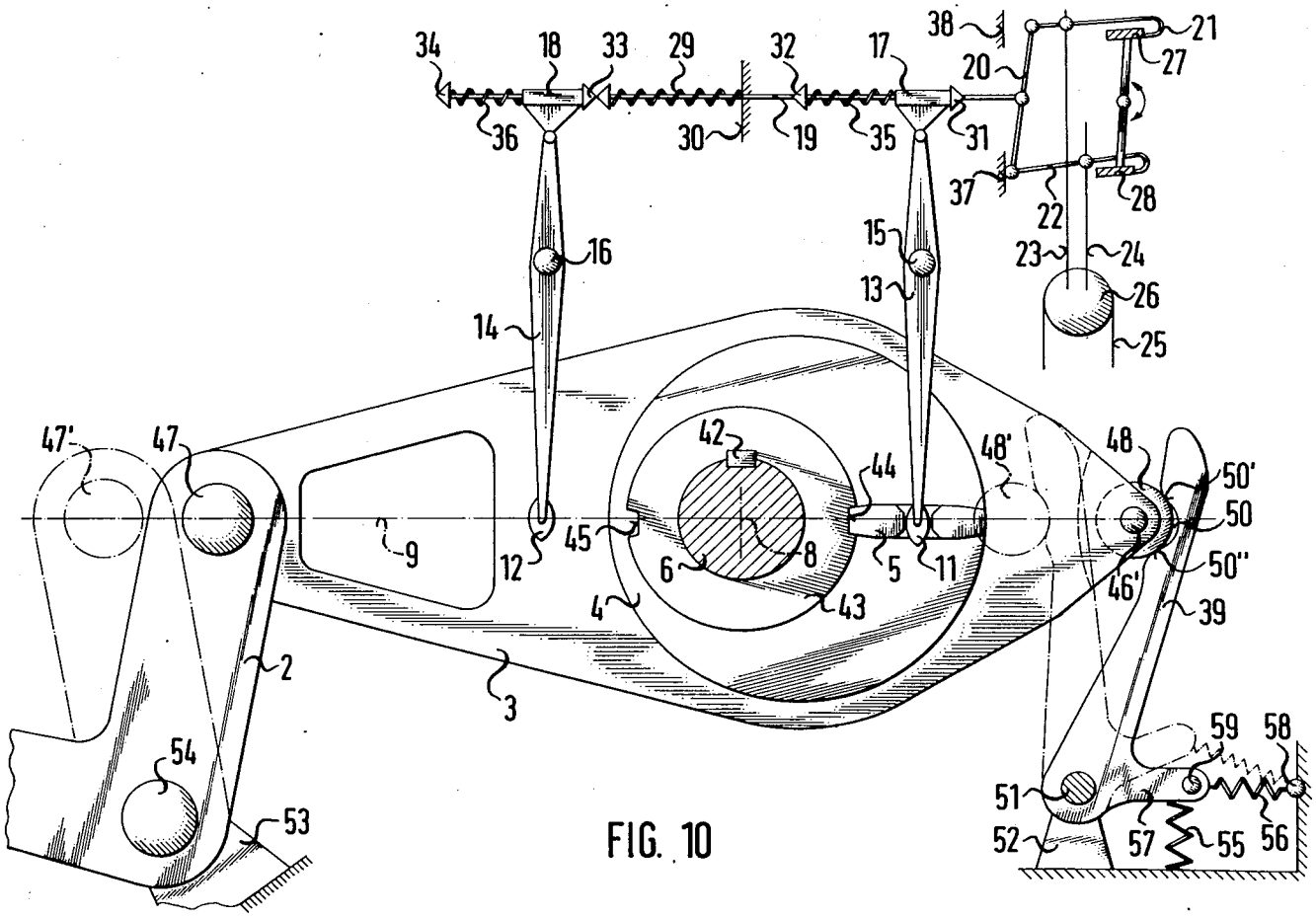
FIGS. 10 to 14 are fragmentary, front-elevational views of different embodiments of arresting means for a connecting rod.

According to FIG. 10, the two shifter rods 13, 14 are pivotally supported on fixed axes 15, 16, and the outer ends thereof are supported in slide bearings 17, 18 connected with a longitudinally sliding control rod 19. The control rod 19 articulates with a balance beam 20. Two thin plates 21, 22 articulate with the balance beam 20, and are connected to scanning or feeler needles 23, 24, respectively. The scanning needles 23, 24 touch a paper card 25, which is conducted over a card cylinder 26. The paper card 25 has openings through which the scanning needles pass. The passage of the scanning needles 23, 24 through the holes in the paper card 25 allows the scanning needles to enter into the card cylinder 26, thereby causing the thin plates 21 and 22 to fall onto followers 27, 28 which are thus moved back and forth.

The control rod 19 is pushed to the left into an end position by a compression spring 29. The compression spring 29 bears against a support 30 and against the slide bearing 18. The slide bearings 17 and 18 are spring mounted on the control rod by the interposition of collars 31–34 and compression springs 35, 36, in order to transmit the position of the scanning needles 23, 24 to the coupling wedge 5. The balance beam 20 occupies a rest position at least at one of two fixed supports 37, 38.

The eccentric disc 4 is freely rotatably supported in the connecting rod or crank 3 with the aid of roller bearings 40 shown in FIGS. 3 to 9. According to FIG. 10, a disc 43 is fixed or keyed to the drive shaft 6 by a key 42 and the outer rim of the disc 43 has two diametrically opposite detent grooves 44 and 45 for the coupling wedge 5. As shown in FIG. 5, the eccentric disc 4 is freely rotatably supported on a concentric shoulder 46 of the disc 43 by roller bearings 41 which are shown in FIGS. 4, 5 and 7 to 9.

The above-mentioned parts are supported inside a housing. The end of the connecting rod 3 with a coupling joint 47 extends out of the housing so that it can be connected to a linkage 2.

Arresting, detenting or stopping means which position the connecting rod 3 in the two engagement positions thereof are provided along a plane 9, indicated by a dot-dash line in FIGS. 10–14. The plane 9 passes through the coupling joint 47, an axis of rotation 8 of the drive shaft 6, the coupling wedge 5 and its detent grooves 44 and 45. The arresting means are formed of mutually meshing parts, one of which is on the connecting rod 3 and the other of which is outside the connecting rod 3.

Specifically, the arresting means are formed of a roller 48 which is rotatably supported on a shaft 46' on the connecting rod 3. The roller 48 is disposed at one end of the connecting rod 3, while the coupling joint 47 is positioned at the opposite end.

Additional arresting, detenting or stopping means are provided in the form of a lever 39 which has a depression 50, so that the lever 39 is resiliently pressed against the roller 48. The lever 39 pivots about a fixed shaft 51 In order to guarantee engagement without play, even after wear has subsequently occurred, the depression 50 has two contact points 50', 50'' for the roller 48.

FIG. 10 indicates that a bracket 52 which is fixed to the machine frame carries the shaft 51 of the lever 39 and an additional bracket 53 carries a rotating shaft 54 of the linkage 2.

The lever 39 has a spring configuration formed of compression springs 55 and 56. Both compression springs bear against the housing. The forces of the springs 55, 56 act on an arm 57 of the lever 39.

The spring configuration is constructed in such a way that the force causing the depression 50 of the lever 39 to contact the roller 48 in the lower shed position, as shown in solid lines in FIG. 10, is equal to the force in the higher shed position indicated by phantom lines, i.e. in the other rest position of the connecting rod 3. In order to achieve this, the spring 56 can swing in a motion corresponding to the lever motion. The spring 56 connects a joint 58 which is fixed to the housing with a joint 59 which is located in the arm 57. FIG. 10 shows that the compression spring 56 has almost no effect in the lower shed position shown in FIG. 10, because the joints 58 and 59 and the shaft 51 of the lever 39 lie almost in the same plane. The spring 55 loads the lever 39 by pressing against the arm 57 from below.

If the lever 39 moves into the position shown with phantom lines as it changes position, the spring 55 becomes less effective, while the effectiveness of the compression spring 56 becomes increasingly greater, although it relaxes, because it acts on the arm 57 with a lever arm which becomes increasingly greater.

At this point, the connecting rod 3 is still in the lower shed position and the control piece 11 of the pattern-controlled shifting device has caused the coupling wedge 5 to become engaged in the detent groove 44 of the disc 43, so that the eccentric disc 4 is taken along as the drive shaft 6 starts again and the connecting rod 3 starts moving and finally moves into the higher shed position. In the higher shed position, the coupling joint 47 is in a position 47' and the roller 48 is in a position 48'.

In the engaged state, the coupling wedge 5 is arrested in the eccentric disc 4 in such a way that it cannot leave the coupled position during the rotation of the eccentric disc.

Figure 3:
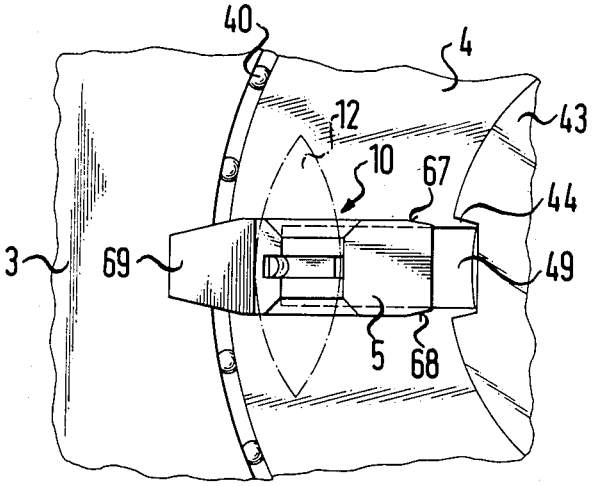
FIG. 3 is a fragmentary front-elevational view of the coupling wedge in the disengaged state.
Figure 4:
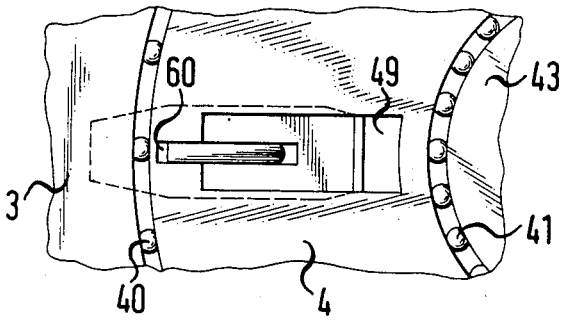
FIG. 4 is a fragmentary, rear-elevational view of the coupling wedge.

The coupling wedge 5, which is shown especially clearly in FIGS. 3 to 9, is supported in a wedge guide 49 of the eccentric disc 4, so that it can slide longitudinally. The wedge guide is an approximately rectangular perforation in the eccentric disc 4 which, according to FIG. 4, is provided with a sliding surface 60 which extends radially outwardly.

As shown in FIG. 5, the sliding surface 60 serves as a cam surface for an engagement nose 61 of a locking pawl 62. The locking pawl 62 can pivot about an axis 63 in an opening 64 formed in the coupling wedge 5 and is loaded by a compression spring 65. The locking pawl 62 also has a cam surface 66.

Figure 9:
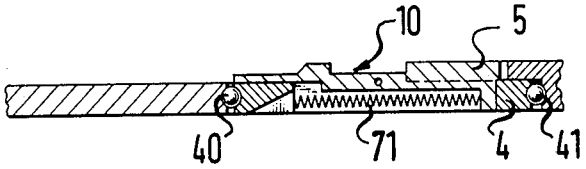
FIG. 9 is a longitudinal-sectional view of the coupling wedge taken along the line IX—IX in FIG. 7, in the direction of the arrows.
Figure 6:
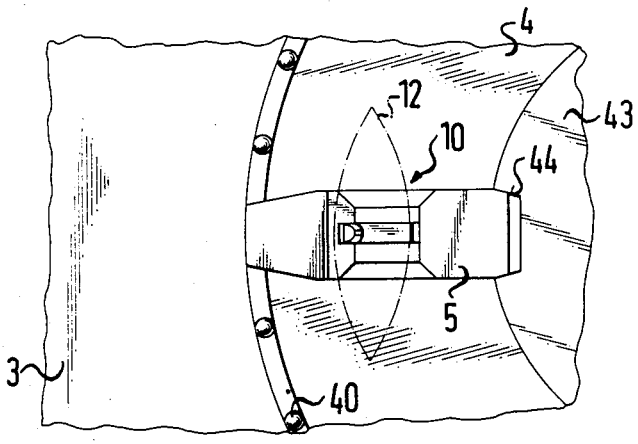
FIG. 6 is a view similar to FIG. 3 of the coupling wedge in the engaged state.
Figure 7:
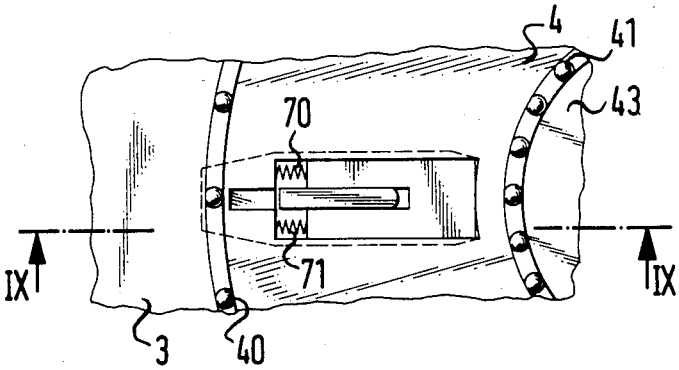
FIG. 7 is a rear view similar to FIG. 4 of the coupling wedge in the engaged state.

Certain parts of the coupling wedge 5 lie on the eccentric disc 4 and certain parts lie on the connecting rod 3. This relates to lateral portions 67, 68 which serve for guiding the wedge and a detenting nose 69. FIGS. 7 and 9 indicate that the coupling wedge 5 is provided with two longitudinal bores or holes, in which compression springs 70, 71 are respectively retained. The compression springs have one end which bears against the coupling wedge 5 and another end which bears against the radially outwardly positioned wall of the wedge guide 49. The springs attempt to slide the coupling wedge in the direction toward the drive shaft 6.

In the lower shed position shown in FIG. 10, the scanning needles 23 and 24 have found holes in the paper card 25, so that the thin plates 21 and 22 are pulled down against the followers 27 and 28. The followers therefore act on the balance beam 20 and lift it alternatingly from the supports 37 and 38. The control rod 19 is therefore pulled toward the right, as shown in FIG. 10.

Figure 8:
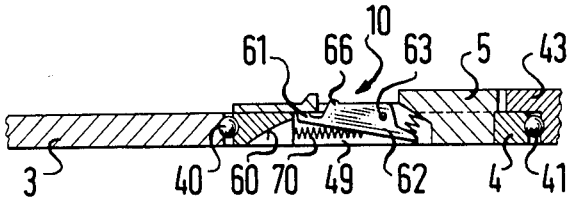
FIG. 8 is a view similar to FIG. 5 of the coupling wedge in the engaged state.

The control rod 19 thus takes along the control rods 13 and 14, so that the coupling wedge 5 engages the detent groove 44 of the disc 43. The engagement takes place when the disc 43 is standing still, because the drive shaft 6 stops its rotation for a short moment after each half revolution. FIGS. 7 to 9 show the position of the coupling wedge 5 in the engaged state, and specifically after the control pieces 11, 12, respectively, have slipped out of the control groove 10. The engagement nose 61 of the locking pawl 62 has engaged behind the radially outer limiting wall of the wedge guide 49, so that the coupling wedge 5 is held securely in the groove 44, not only by the force of the springs 70, 71, but also by mechanical locking, even if centrifugal forces act on the coupling wedge 5, during subsequent rotation of the eccentric disc 4.

After a half revolution of the eccentric disc 4, the control piece 12 enters the groove 10 of the coupling wedge 5, unlocks the locking pawl 62 by depressing the cam surface 66 and moves the coupling wedge 5 out of the detent groove. The higher shed position which is illustrated in FIG. 3 has thus been reached.

The higher shed position is maintained until the scanning needles 23, 24 are displaced from the card cylinder 26 and come to rest on the paper card 25, according to the pattern. In this way, the thin plates 21, 22 lose contact with the followers 27, 28, so that the balance beam 20 rests on the supports 37, 38 due to the action of compression spring 29. Simultaneously, the compression spring 29 moves the control rod 19 to the left and the two control rods 13, 14 swing counter clockwise. The control piece 12 of the control rod 14 therefore moves the coupling wedge 5 into one of the two detent grooves 44, 45. The coupling wedge 5 and the eccentric disc 4 are therefore taken along by the rotating disc 43 and the higher shed position is changed to the lower shed position shown in FIG. 10. The lower shed position remains unchanged and stable as long as the scanning needles 23 and 24 cannot find an opening to fall through.

FIG. 5 shows the coupling wedge 5 with the control piece 12 engaged. The control piece 12 has unlocked the locking pawl 62 by depressing the cam surface 66. Under the action of the compression spring 65, the locking pawl 62 is engaged again each time, as soon as the control piece 11 or 12 is withdrawn from the shifting groove 10 of the coupling wedge 5 after the coupling wedge has become engaged.

Figure 11:
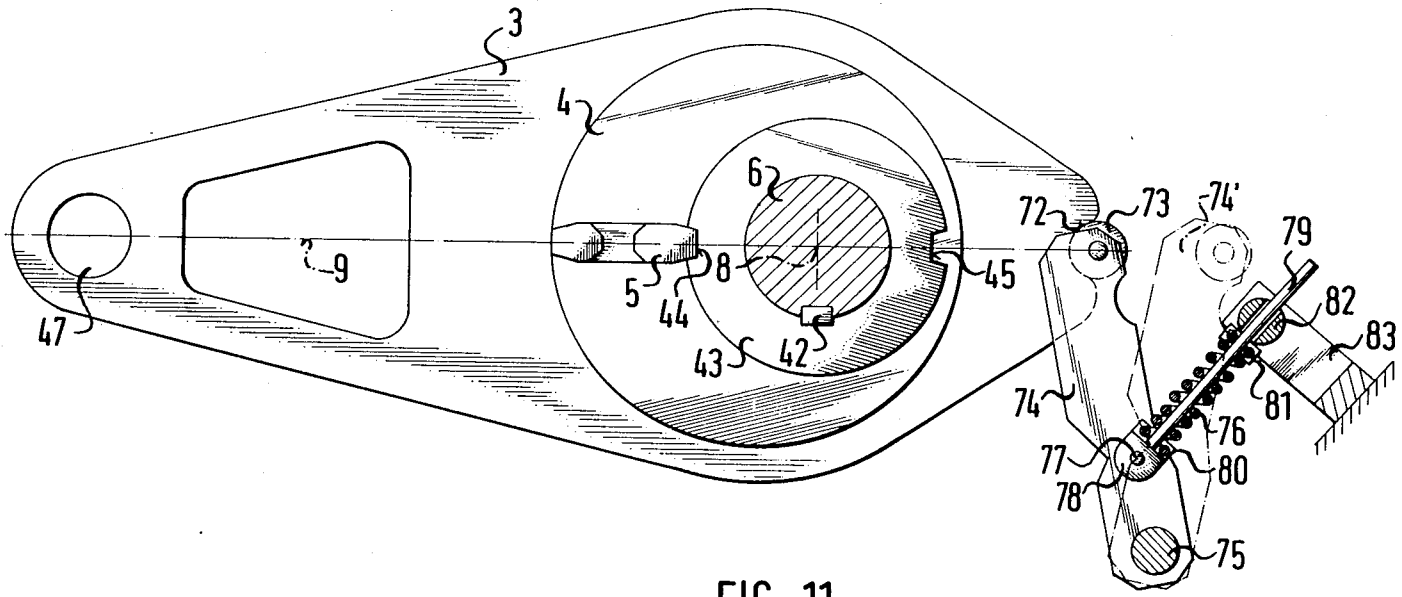

In the embodiment according to FIG. 11, the connecting rod 3 is provided with first arresting, detenting or stopping means in the form of a notch 72 at the end thereof opposite the coupling joint 47. The depression 72 lies in the plane 9, which passes through the connecting rod 3, the coupling joint 47, the axis of rotation 8 of the drive shaft 6, the coupling wedge 5 and its detent grooves 44, 45 in the rest position. Second arresting, detenting or stopping means in the form of a roller 73 can be resiliently engaged in the notch 72. The roller 73 is disposed on a lever 74. The lever 74 pivots about a fixed shaft 75.

The lever 74 is loaded by a compression spring 76. The spring 76 pivots in a motion corresponding to the motion of the lever and therefore changes its direction and the force acting on the lever 74. In order to accomplish this, the following structure is provided:

The lever 74 carries a pin 77 on which a spring carrier 78 is rotatably supported. The spring carrier 78 includes a rod 79 on which a lower spring washer 80, the spring 76 and an upper spring washer 81 are disposed. The rod 79 can slide in an opening in a cross bar 82, which is rotatably supported in openings formed in a fixedly positioned fork 83. The upper spring washer 81 bears against the cross bar 82.

If the lever 74 is moved to the position 74' during a position change of the connecting rod 3, the spring 76 also moves, which changes the direction and strength of the spring force acting on the lever 74. This force is adjusted in such a way that the force with which the roller 73 presses against the notch 72 is approximately equal in both rest positions of the connecting rod 3.

Figure 12:
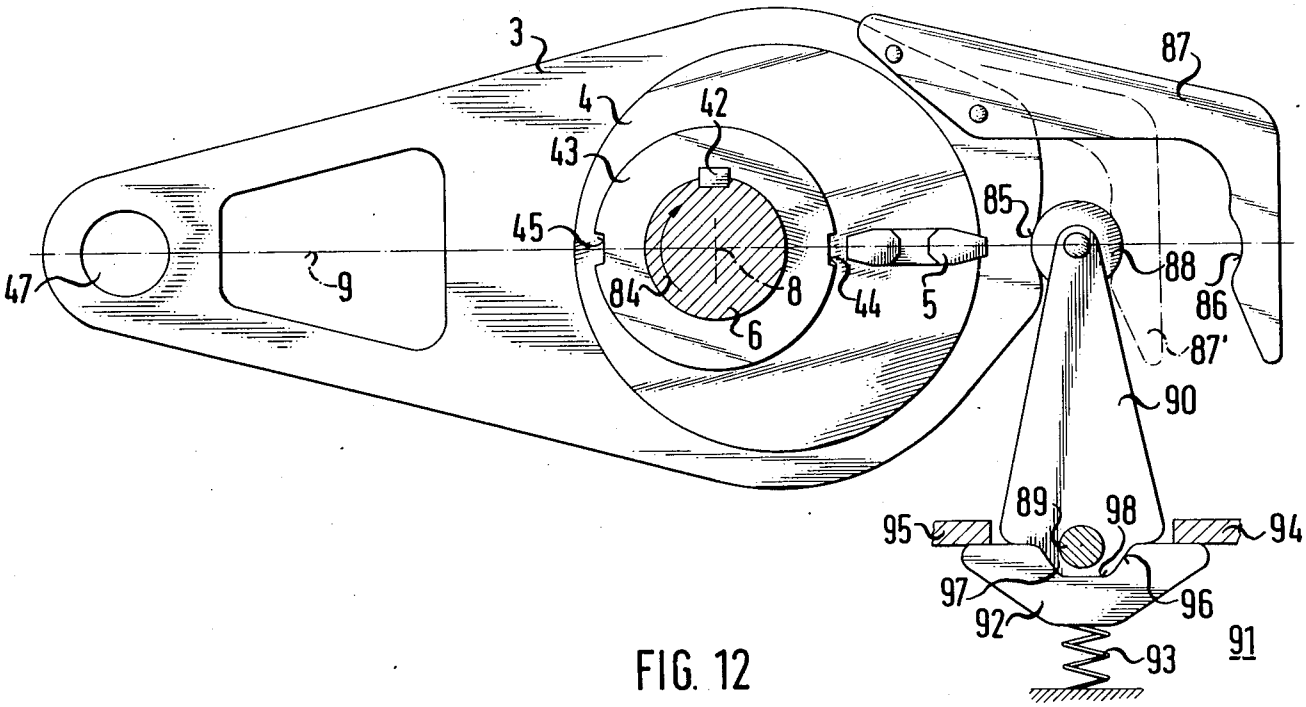

In the embodiment according to FIG. 12, the connecting rod 3 is in the lower shed position. Since the coupling wedge 5 is disengaged, the lower shed position is maintained even if the drive shaft 6 continues to rotate in the direction of an arrow 84.

In the FIG. 12 embodiment, the connecting rod 3 is provided with a first depression 85 at the end thereof opposite the coupling joint 47. In the rest position, the depression 85 also lies in the plane 9, which passes through the coupling joint 47, the axis of rotation 8 of the drive shaft 6, the coupling wedge 5 and its detent grooves 44 and 45.

A second depression 86 is formed in an arm 87 which is connected to the connecting rod 3. The second depression 86 is opposite the first depression 85 in the same plane 9.

A roller 88 can be resiliently engaged either in the depression 85 or in the depression 86. This depends on the respective position of the connecting rod 3.

The roller 88 is rotatably disposed on a lever 90, which is pivotal about a fixed shaft 89.

The lever 90 has a spring-loaded zero setting device 91. The zero setting device 91 has a rocker 92 which is biased from the bottom against fixed stops 94, 95 and against a lower surface 96 of the lever 90, by a spring 93.

The lower surface 96 of the lever 90 is not flat, but rather has a tooth-like configuration. The rocker 92 is connected with the lever 90 due to the fact that a matching tooth gap 98 surrounds a tooth 97 of the lever 90.

The construction of the zero setting device 91 guarantees the resilient shifting of the lever 90 to the left and to the right.

If the connecting rod 3 is moved into the higher shed position, the arm 87 moves to a position 87' and its depression 86 lies on the roller 88.

In order to assure contact of the roller 88 in one of the depressions 85, 86 without play and with a defined force, the lever is disposed in such a way that in each case it moves either to the left or to the right against the force of the spring 93.

During the normal movement of the connecting rod 3 the roller 88 will pass over the protrusions which lie adjacent the depression 85, 86. When this occurs, the roller 88 and lever 90 will pivot about point 89 causing the rocker 92 to move away from one of the two stops 94, 95. The spring 93 will compensate for this displacement by urging the rocker 92, lever 90 and roller 88 back to the balanced position shown in FIG. 12. Such an arrangement assures that the roller 88 will engage the depression 85, 86 during the rest period.

Figure 13:
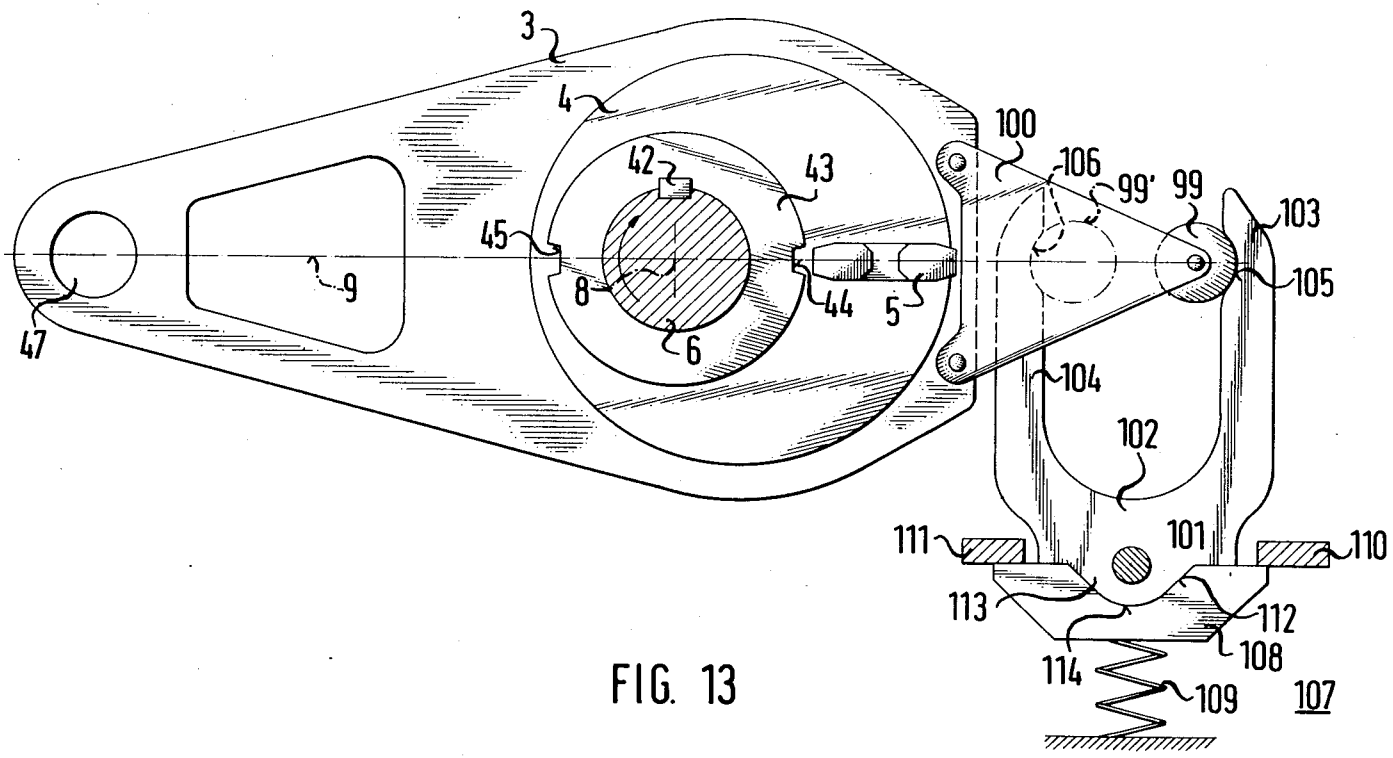

In the construction according to FIG. 13, the connecting rod 3 is provided with a roller 99 at the end thereof opposite the coupling joint 47. The roller 99 also lies in the plane 9 and is held by a cross piece 100 which is connected to the connecting rod 3.

A lever 102 which pivots about a fixed shaft 101 is provided with two arms 103, 104, which reach around the roller 99 of the connecting rod 3. The arm 103 has a depression 105 and the arm 104 has a depression 106. The depression 105 can contact the roller 99 from the right and the depression 106 can contact the roller from the left.

Similar to the construction according to FIG. 12, a zero setting device which is designated as a whole with reference numeral 107, is provided for the lever 102.

The zero setting device 107 is provided with a rocker 108, which is biased from the bottom against two fixed stops 110 and 111 by the action of a compression spring 109. Furthermore, the rocker 108 contacts a lower surface 112 forms a tooth 113, which matches in a tooth gap 114 in the rocket 108.

The lever 102 can only move to the left or right side from the zero position shown in FIG. 13 against the force of the spring 109. This happens every time a limited portion of the roller 99 contacts either the depression 105 or the depression 106.

When the connecting rod 3 is in the higher shed position, the roller 99 is in a position 99'.

Figure 14:
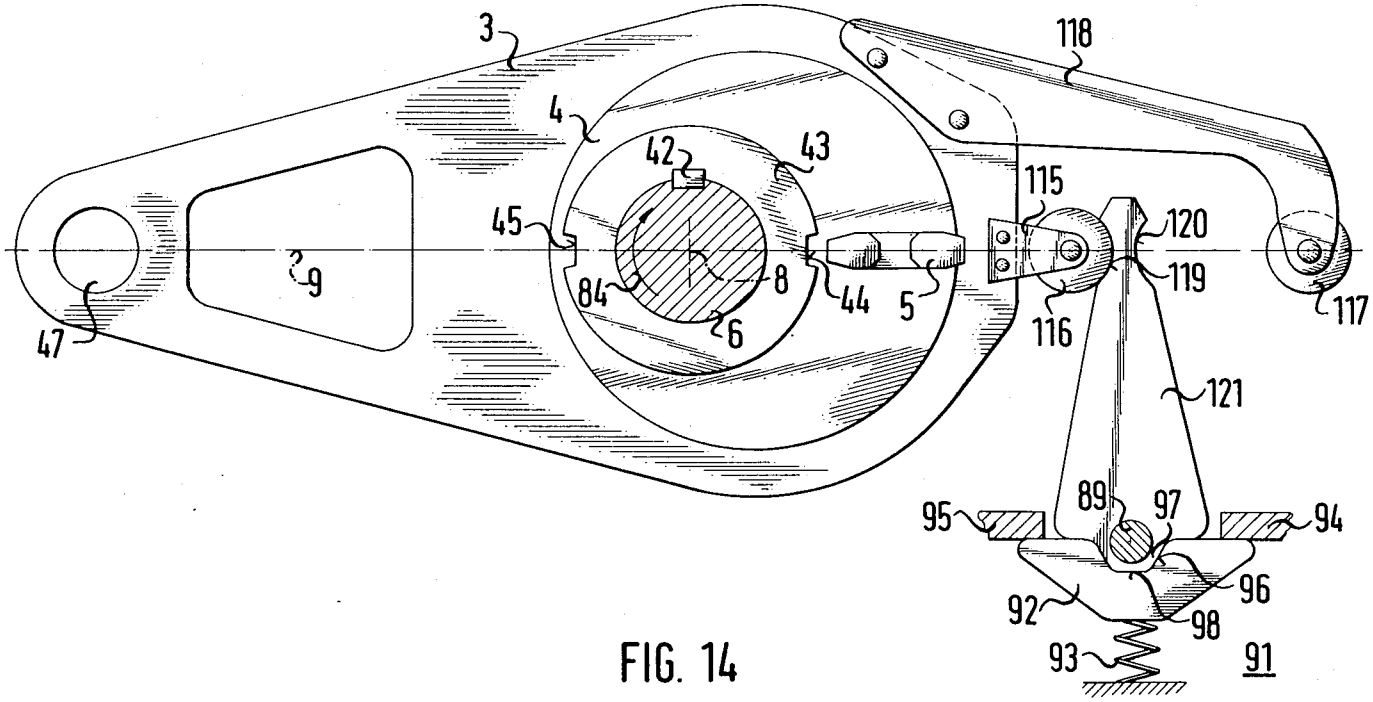

The embodiment according to FIG. 14 differs from the embodiment according to FIG. 12 as follows:

The end of the connecting rod 3 opposite the coupling joint 47 is provided with a cross piece 115, which carries a first roller 116. The roller 115 also lies in the plane 9. A second roller 117 is disposed on an arm 118 which is connected to the connecting rod 3. The second roller is opposite the first roller 116 in the same plane. A lever 121 which has depressions 119, 120 on both sides thereof, pivots on a fixed shaft 89 and can resiliently contact either of the two rollers. The particular roller being contacted depends on the respective position of the connecting rod 3.

The lever 121 is provided with a zero setting device 91 similar to the device illustrated in FIG. 12. In order to avoid repetition, the zero setting device 91 will not be further described at this point.

The lower surface 96 of the lever 121 is constructed exactly like the lower surface of lever 90. The tooth 97 of the lever 121 is also constructed like the tooth of the lever 90.

The invention is not limited to the illustrated and described embodiments which were used as examples.

Compression springs were used in the preceding typical embodiments for applying the forces acting on the arresting means. However, tension springs might be used in alternate configurations, for example.

As another alternative, pneumatic means might be used for loading the arresting means. Pneumatic means make it especially easy to obtain constant strength of the required forces that are applied and to assure the resilient shifting of the detenting means.

I claim:

1. Rotary dobby, comprising a driven drive shaft assembly stopping in a rest position every 180°, an eccentric mechanism including a connecting rod having a coupling joint to be connected to a shaft linkage and an eccentric disc carried by said connecting rod, said eccentric disc having a radially directed wedge guide formed therein, said drive shaft assembly having two diametrically opposite detent grooves formed therein, a coupling wedge, means for shifting said coupling wedge in said wedge guide and in said detent grooves according to a pattern during said rest position of said drive shaft assembly, said eccentric disc and said connecting rod, means in the form of two mutually interlocking parts for arresting said arresting said connecting rod in two rest positions thereof, one of said parts being disposed on said connecting rod and the other of said parts being disposed outside said connecting rod, and means for resiliently deflecting at least one of said parts into contact with the other, one of said parts being a roller disposed on said connecting rod, the other of said parts being in the form of a lever with two arms extending at least partly around said roller, said arms each having a respective depression formed therein matching said roller, and including a fixed axis about which said lever pivots for engaging said roller in said depressions from respective opposite sides of said roller.

2. Rotary dobby according to claim 1, wherein said drive shaft assembly includes a drive shaft and a disc connected to said drive shaft having said detent grooves formed therein.

3. Rotary dobby according to claim 1, wherein said lever has a lower surface, and said resilient deflecting means includes a zero setting device having fixed stops, a rocker interlocking with said lever, and a spring biasing said rocker against said lower surface of said lever and against said fixed stops.

4. Rotary dobby, comprising a driven drive shaft assembly stopping in a rest position every 180°, an eccentric mechanism including a connecting rod having a coupling joint to be connected to a shaft linkage and an eccentric disc carried by said connecting rod, said eccentric disc having a radially directed wedge guide formed therein, said drive shaft assembly having two diametrically opposite detent grooves formed therein, a coupling wedge, means for shifting said coupling wedge in said wedge guide and in said detent grooves according to a pattern during said rest position of said drive shaft assembly, said eccentric disc and said connecting rod, means in the form of two mutually interlocking parts for arresting said connecting rod in two rest positions thereof, one of said parts being disposed on said connecting rod and the other of said parts being disposed outside said connecting rod, means for resiliently deflecting at least one of said parts into contact with the other, and an arm connected to said connecting rod, one of said parts being in the form of a depression formed in said arm and a depression formed in said connecting rod and directed against said depression formed in said arm, the other of said parts including a roller matching said depressions, and said resilient deflecting means selectively moving said roller into engagement with said depressions.

5. Rotary dobby according to claim 4, wherein the other of said parts includes a lever carrying said roller and being pivotable about a fixed axis, and said resilient deflecting means includes a spring mechanism having at least one spring pivoting in accordance with the motion of said lever for changing the direction and strength of the force of said spring.

6. Rotary dobby according to claim 5, wherein said lever has a lower surface, and said resilient deflecting means includes a zero setting device having fixed stops, a rocker interlocking with said lever, and a spring biasing said rocker against said lower surface of said lever and against said fixed stops.

7. Rotary dobby according to claim 4, wherein said drive shaft assembly includes a drive shaft and a disc connected to said drive shaft having said detent grooves formed therein.

8. Rotary dobby, comprising a driven drive shaft assembly stopping in a rest position position every 180°, an eccentric mechanism including a connecting rod having a coupling joint to be connected to a shaft linkage and an eccentric disc carried by said connecting rod, said eccentric disc having a radially directed wedge guide formed therein, said drive shaft assembly having two diametrically opposite detent grooves formed therein, a coupling wedge, means for shifting said coupling wedge in said wedge guide and in said detent grooves according to a pattern during said rest position of said drive shaft assembly, said eccentric disc and said connecting rod, means in the form of two mutually interlocking parts for arresting said connecting rod in two rest positions thereof, one of said parts being disposed on said connecting rod and the other of said parts being disposed outside said connecting rod, means for resiliently deflecting at least one of said parts into contact with the other, and an arm connected to said connecting rod, one of said parts being in the form of a first roller disposed on said arm and a second roller disposed on said connecting rod opposite said first roller, the other of said parts including a lever having two sides with depressions formed therein and being pivotable about a fixed axis, and said resilient deflecting means selectively moving one of said depressions into engagement with one of said rollers.

9. Rotary dobby according to claim 8, wherein said lever has a lower surface, and said resilient deflecting means includes a zero setting device having fixed stops, a rocker interlocking with said lever, and a spring biasing said rocker against said lower surface of said lever and against said fixed stops.

10. Rotary dobby according to claim 8, wherein said drive shaft assembly includes a drive shaft and a disc connected to said drive shaft having said detent grooves formed therein.

* * * * *